US009187968B2

(12) United States Patent
Hole et al.

(10) Patent No.: US 9,187,968 B2
(45) Date of Patent: Nov. 17, 2015

(54) FLUID PARTITION UNIT

(75) Inventors: Ove Hole, Hafrsfjord (NO); Harald Syse, Roeyneberg (NO)

(73) Assignee: REELWELL AS (NO)

( * ) Notice: Subject to any disclaimer, the term of this patent is extended or adjusted under 35 U.S.C. 154(b) by 277 days.

(21) Appl. No.: 13/701,826

(22) PCT Filed: Jun. 24, 2011

(86) PCT No.: PCT/EP2011/060635

§ 371 (c)(1),
(2), (4) Date: Dec. 5, 2012

(87) PCT Pub. No.: WO2011/161250

PCT Pub. Date: Dec. 29, 2011

(65) Prior Publication Data

US 2013/0087389 A1 Apr. 11, 2013

(30) Foreign Application Priority Data

Jun. 25, 2010 (NO) ..... 20100925

(51) Int. Cl.
*E21B 21/12* (2006.01)
*E21B 21/08* (2006.01)
*E21B 17/18* (2006.01)

(52) U.S. Cl.
CPC ..... *E21B 21/12* (2013.01); *E21B 17/18* (2013.01); *E21B 21/08* (2013.01)

(58) Field of Classification Search
CPC ..... E21B 7/20; E21B 7/18; E21B 21/12
USPC ..... 175/320, 57, 171, 251
See application file for complete search history.

(56) References Cited

U.S. PATENT DOCUMENTS 2,716,018 A * 8/1955 Williams ..... 175/98
3,151,690 A * 10/1964 Grable ..... 175/321
3,638,742 A 2/1972 Wallace
4,057,118 A 11/1977 Ford
4,168,755 A * 9/1979 Willis ..... 175/343
4,534,426 A 8/1985 Hooper
4,718,503 A * 1/1988 Stewart ..... 175/70

(Continued)

FOREIGN PATENT DOCUMENTS

AU 444110 B2 12/1973
WO 2004018828 A1 3/2004

(Continued)

OTHER PUBLICATIONS

International Search Report and Written Opinion of the International Searching Authority from PCT/EP2011/060635, mailed on Nov. 27, 2012.

(Continued)

*Primary Examiner* — Jennifer H Gay
(74) *Attorney, Agent, or Firm* — Adenike Adebiyi

(57) ABSTRACT

A method to be used when performing drilling in a well bore involves positioning a dual bore drill pipe in a well bore. An outer annulus formed between the drill pipe and well bore wall is divided into two different sections. A first fluid is provided in one of the sections. A second fluid having a density less than the first fluid is circulated into and out of the well bore through the drill pipe. The densities of the first and second fluids are such that the drill pipe is at least partly floating in the first fluid in the outer annulus.

13 Claims, 1 Drawing Sheet

(56) References Cited

U.S. PATENT DOCUMENTS

| | | | | |
|---|---|---|---|---|
| 5,060,737 | A | 10/1991 | Mohn | |
| 5,964,294 | A | 10/1999 | Edwards | |
| 6,892,829 | B2 * | 5/2005 | Livingstone | 175/57 |
| 7,093,675 | B2 * | 8/2006 | Pia | 175/57 |
| 7,152,700 | B2 * | 12/2006 | Church et al. | 175/320 |
| 8,555,962 | B2 * | 10/2013 | Vestavik | 166/188 |
| 8,833,489 | B2 * | 9/2014 | Hogset et al. | 175/40 |
| 2003/0141111 | A1 | 7/2003 | Pia | |
| 2003/0226689 | A1 * | 12/2003 | deBoer | 175/7 |
| 2004/0104052 | A1 | 6/2004 | Livingstone | |
| 2005/0103527 | A1 * | 5/2005 | Church et al. | 175/62 |
| 2006/0124306 | A1 * | 6/2006 | Vail | 166/285 |
| 2008/0073123 | A1 | 3/2008 | Mullins et al. | |
| 2011/0240285 | A1 * | 10/2011 | Vestavik | 166/188 |
| 2013/0087389 | A1 * | 4/2013 | Hole et al. | 175/65 |
| 2014/0083776 | A1 * | 3/2014 | Hogset et al. | 175/57 |
| 2014/0190751 | A1 * | 7/2014 | Vestavik | 175/65 |

FOREIGN PATENT DOCUMENTS

| | | | |
|---|---|---|---|
| WO | 2006014417 | A2 | 2/2006 |
| WO | 2010039042 | A2 | 4/2010 |
| WO | 2010039043 | A1 | 4/2010 |

OTHER PUBLICATIONS

Norwegian search report from Norwegian patent application No. 20100925, dated Jan. 24, 2011.

* cited by examiner

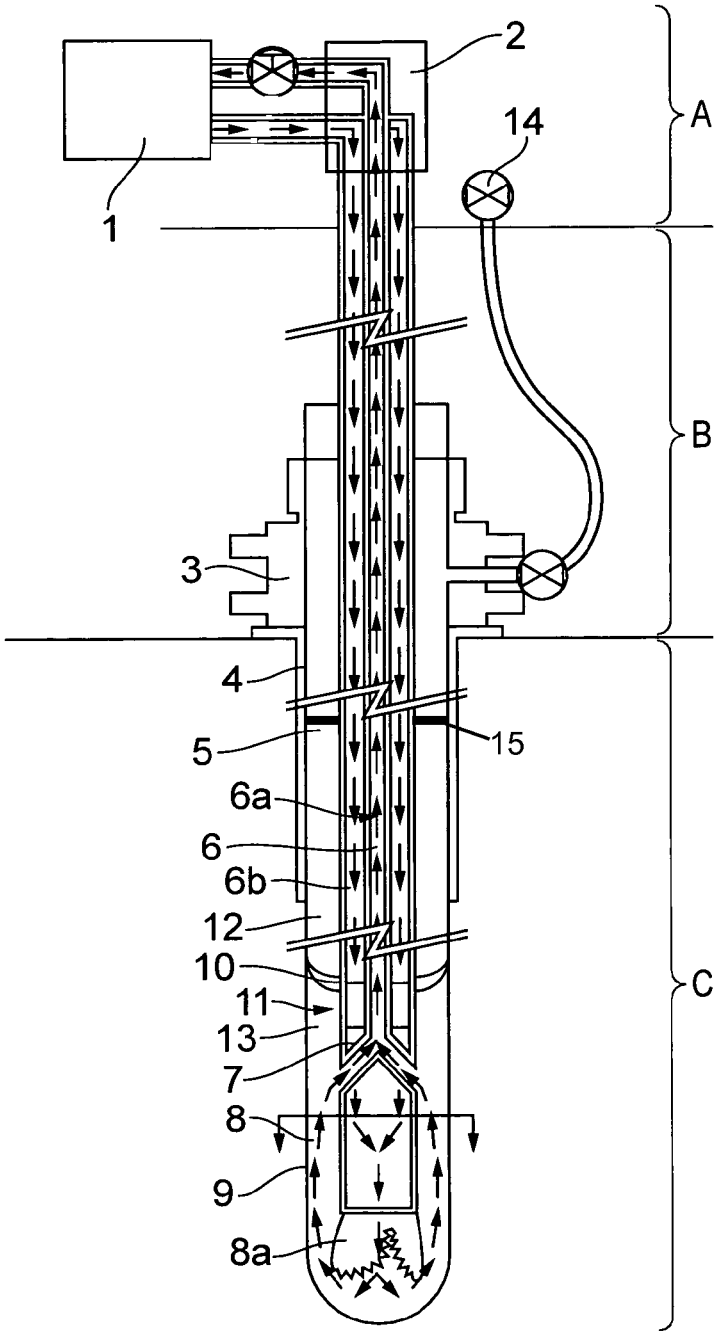
2
14
A
1
B
3
4
5
15
6a
6
6b
12
10
C
11
13
7
8
9
8a

FLUID PARTITION UNIT

FIELD

The present invention regards a method and device for performing drilling activities in a well.

BACKGROUND

To extract petroleum fluids from a reservoir in an earth formation, wells are drilled into the earth formations. The development of drilling techniques has now evolved into the possibility of drilling wells in all directions to extract as much as possible out of a reservoir. A well may for instance comprise a mainly vertical section and at least one section which deviate from this vertical direction, possibly a mainly horizontal section. These sections of the well which deviate from a mainly vertical direction tend to become longer, and may extend for several thousand meters into a formation. The depth of the wells is also increasing and in addition the water depths for drilling wells are also increasing.

Drilling is normally performed by inserting a drilling bit on the end of a drill string into the well. The weight of the drill string is proportional with the length of the drill string. When drilling at large water depths the depth of the water also influences the pressure conditions in the well and the formation as such and adds to the weight of the drill string. During drilling one does not want formation fluid to penetrate the drilled well, so the pressure exerted by the drilling equipment on the formation should be higher than the formation pore pressure. With drilling equipment one should also understand the fluid added between the drill string and the unlined formation wall. With this one also has control of the well during drilling and will therefore prevent blow outs. At the same time there is also a need to limit the amount of drilling fluid that penetrate the unlined formation wall, and also a need to prevent fracturing the side wall of the drilled bore before production should start. This gives that the pressure exerted by the drilling equipment must not exceed a fracturing pressure of the formation. The formation pressure is also influenced by the hydrostatic pressure, and at larger water depths this also increases. When the pressure exerted by the drilling equipment moves towards the boundaries, the fracturing pressure or the formation pore pressure, the well needs to be provided with casings or liners before one may drill further in the well. This would often mean pulling the drilling equipment out of the well, and providing new sections of casing or liners in the well before one may continue with the drilling. There is therefore a general need to develop methods for performing drilling where the drilling for a longer period may be performed in the allowed pressure range, between the formation pore pressure and the formation fracturing pressure.

Another element is when the well deviates from a vertical direction at least a part of the drill string will due to gravity forces also tend to come in contact with the wall of the bore hole. For a horizontal section the drill pipe will tend to rest on the relative lower part of the borehole wall. This contact between the drill string and the borehole wall will create friction as the drill string is moved further into the well during drilling or when it is moved out or into the well.

As wells are drilled at greater water depths and further into the ground and deviated well becomes longer, the weight of the drill string and friction forces increases. There will naturally be a limit on how much weight and friction forces the equipment for performing the drilling may take and this will limit the reach of a conventional drilling string.

In U.S. Pat. No. 5,060,737 there is described a drilling system for deviated drilling. There is in this publication described several ways of providing advancement of the drill string in the well bore. In US2004/0104052, WO 2004/018828, WO2006/014417 and US2008/0073123 there are described different methods for performing drilling with a dual bore pipe. There is in U.S. Pat. No. 5,964,294 described a tool for performing a down hole function in a horizontal or highly deviated well.

SUMMARY

An aim with the present invention is to provide a method and device which eliminated or at least reduced the drawback mentioned above in connection with convention drilling.

These aims are met with a method and device as defined in the attached claims.

The present invention regards a method to be used when performing drilling in a well bore, comprising: positioning a dual bore drill pipe with a drilling tool at on one end in a well bore, thereby forming an outer annulus between the well bore wall and the pipe, dividing the outer annulus into two different sections along the longitudinal axis of the pipe, at least at one location in close proximity to the tool, providing a first fluid in the outer annuls and providing a second fluid within the drill pipe and around the tool, thereby having the possibility to provide the fluid in the outer annulus with specific properties, independent on the properties of the second fluid within the drill pipe. By positioning a pipe with a drilling tool at one end in a well bore, would imply that the other end of the pipe is positioned above the well bore and accessible from the surface facility.

With this method one may provide a fluid with specific properties adapted for the formation fracturing pressure and the formation pore pressure in the area where the well is to be drilled in the outer annulus. The specific gravity of this fluid may be different than the fluid used within the drill pipe to perform the drilling activities. By this one achieves the possibility to drill wells in longer parts without the need to provide liners or casings in the well, as the pressure exerted from the drilling equipment on the formation may be specifically adapted to that part of the formation. With such a method there is also the possibility of providing the drill pipe with at least some buoyancy in the well in more horizontal sections and thereby limit the friction forces between the drill pipe and the well bore as will be explained below. Additionally there is also the possibility to divide the outer annulus into more sections and have different fluids in the outer annulus in the different sections, and thereby have the possibility of drilling even further without lining the well with casings or in deviated wells.

In one embodiment the outer annulus is divided in a region of the well bore where there is uniform pressure, and thus where the pressure is substantially equal on both sides of the divider element, i.e. the pressure of the two different fluids near the divider element is substantially the same.

According to one aspect the method may comprise circulating the second fluid within the pipe through the two bores in the pipe. The pipe may also be another kind of pipe and the tool a different tool for performing another kind of activity in the well.

According to one aspect the method may comprise circulating the second fluid into the well bore through a second annular space formed between an outer pipe and an inner pipe forming one of the bores of the dual bore drill pipe, and out of the well bore through a central bore of the inner pipe forming the other bore of the dual bore drill pipe.

According to an embodiment the method may comprise providing the second fluid with a density which is less than a density of the first fluid, whereby the density of the fluids are such that the dual bore drill pipe is at least partly floating in the first fluid in the outer annulus. By having at lighter fluid within the dual bore drill pipe than outside the dual bore drill pipe, where this weight of the lighter fluid together with the weight of the dual bore drill pipe, for a volume unit is less than the weight of the same volume unit of the first fluid positioned in the outer annulus, the dual bore drill pipe will, among other due to the principles of Archimedes experience, a buoyancy force as the dual bore drill pipe is submerged within the first fluid. This buoyancy force will reduce or eliminate friction forces between the dual bore drill pipe and the wall of the well bore as the dual bore drill pipe is moved along the well bore. As the friction forces during movement of the drill pipe are reduced, same equipment topside may then move a longer drill pipe, thereby extending the reach for performing deviated drilling. Also the force from the weight of the dual bore drill pipe, hanging in a mainly vertical section of the well bore, and thereby also hanging off in equipment topside will be reduced due to buoyancy forces counteracting the gravitation forces, when the weight of a volume unit of dual bore drill pipe together with the second fluid is less than the weigh of a volume unit of a fluid in the outer annulus in the vertical section of the well bore.

According to another aspect the method may comprise dividing the outer annulus at least at two locations, providing a first fluid in the outer annulus between the two locations, and a third fluid in the annulus outside this section. By such a method the fluids in the outer annulus between the wall of the bore hole and the pipe may be adapted to the specific properties of the well at that position. One may use several different fluids along a drill string in a long and possibly deviated well.

The present invention also regards a drilling device comprising a dual bore drill pipe, a tool attached at one end of the dual bore drill pipe, where the dual bore drill pipe and tool is so configured that a fluid is delivered down to the tool through one bore in the drill pipe and returned to the surface through a second bore in the drill pipe. According to the invention the device further comprises a divider element attached around the outside of the drill pipe at the connection of the tool to the drill pipe for dividing an outer annular space formed between the dual bore pipe and the wall of the well bore from the section around the tool. The outer annular space is then divided into a first annular space and a second annular space, comprising the section around the tool. According to the invention the device further comprises means for providing a first fluid in the first annular space and a second fluid within the drill pipe and the second annular space.

The divider element is in one embodiment arranged in a location close to the tool, i.e., in a region which does not comprise casing/liner and relatively further from the entry point of the well.

According to an aspect the dual bore pipe may comprise an outer pipe and an inner pipe arranged to form an inner annular space between the outer pipe and the inner pipe.

According to another aspect the device may further comprise a sealing element arranged around the drill pipe in a distance from the divider, configured to divide the first annular space in two sections, and means for providing a third pressurized movement fluid in the section of the first annular space arranged relatively above the sealing element, for performing pressure assisted drilling. Relatively above, or behind should be understood to be closer to the entry point of the well or the surface. The element or fluid is behind the other element when the drill string is inserted into the well. The sealing element will be positioned in a part of the well where there is installed liners or casings, to provide a good sealing between the two sections of the outer annulus, such that one may build a pressure difference across this sealing element.

The divider element according to the invention is adapted to divide the sections, but it is not necessary that it provides a sealed division. The divider element would normally divide two different fluids from each other, where there is substantially no pressure difference across the divider element. This means that the divider element is arranged in a region of the well bore where there is uniform pressure, and thus where the pressure is substantially equal on both sides of the divider element, i.e., the pressure of the two different fluids near the divider element is substantially the same. The divider element would also normally be operated in a part of the well bore which has not yet be lined, with liners or casings, i.e. an unlined well bore. An unlined well bore wall may have a surface which is rough. The divider element operated against this rough well bore wall is configured such that it divides the fluids on the two opposite sides of the divider element. One possible configuration of the divider element is a divider element comprising several disks, for instance three, four or six or more disks arranged after each other in the longitudinal direction of the pipe. Such a disk may be similar to a pigging disk. There is also the possibility of having the divider element comprising an inflatable element, a foam plug or similar.

The system and method of the present invention may be used with a riserless drilling system or with a drilling system with a marine riser.

BRIEF DESCRIPTION OF THE DRAWINGS

FIG. 1, the sole FIGURE, is a schematic of a drilling system.

DETAILED DESCRIPTION

The invention will now be explained with an embodiment with reference to the attached drawing showing the principle of the invention.

FIG. 1 shows schematically a well drilling subsea, with a riserless system. Arrangements on a floater are schematically shown with reference A, the part of the equipment arranged in the water is schematically indicated with reference B, and the part in the ground for performing the drilling is indicated with reference C. On the floater there will be arranged fluid treatment and circulation system 1, providing a drilling fluid into a dual bore drill string 6, extending from above the water and down to the bottom hole assembly 8, comprising a drill bit 8*a*. There will on the floater also be arranged a top drive adapter 2, allowing the dual drill string 6 to be rotated while routing the fluid to the fluid treatment and circulation system 1.

There is on top of the well extending into the ground arranged a BOP 3. A casing 4 is installed in parts of the well, and extending partially into the ground. There is between the dual drill string 6 and the casing 4 or the wall 9 of the well bore, below the casing 4 formed an outer annulus 11. There is in this outer annulus 11 arranged a divider element 10, dividing the outer annulus 11 into a first section 12 relatively above the divider element 10 and a second section 13 further into the well. There is through means 14 for providing a first fluid in this first section 12, provided a first fluid, as a barrier fluid in this first section. The means 14 comprises among other things a fluid line extending to the floater as indicated in the figure. There is through the fluid treatment and circulation system 1 on the floater provided a second fluid within the dual drill string 6*a*, 6*b* down to the tool in the end of the drill string 6. The tool in this embodiment comprising the bottom hole assembly 8 with the drill bit 8*a* and a dual float valve 7. The valve 7 is arranged such that a fluid led down in the well through a second annulus 6*b* formed between an outer and an inner pipe forming the dual drill string 6, is guided to a central flow through the drill bit 8*a* and from an annular flow around the drill bit 8*a*, and into a central bore 6*a* of the dual drill pipe 6 up to the floater. The second fluid is divided from the first fluid by the divider element 10. As seen in the figure the divider element 10 is operated in the part of the well without a casing 4 between the well bore and the formation, as is the case in the upper part of the well, which has been previously drilled. This lower part of the well, or said with other word the inner part of the well, is drilled and the divider element may be used before this part is lined. The divider element is normally arranged in a region of the well bore where there is uniform pressure, and thus where the pressure is substantially equal on both sides of the divider element. By adapting the first fluid above the dividing element 10 to the formation one may drill longer passages of the well before liners and or casing 4 has to be installed in the well, as one may better control the pressure exerted by the drilling equipment on the unlined wall of the well.

There is also the possibility of providing the drilling system with a riser extending between an upper end of the casing and up to a floater. There is also the possibility of providing a sealing element 15 in a part of the well with a casing 4, and providing a third fluid above this sealing element 15 and thereby provide pressure assisted drilling with the system according to the invention. There may also be more than one dividing element arranged around the dual drill pipe.

The invention has now been explained with reference to a non-limiting embodiment and a skilled person would understand that there may be made alterations and modifications to the embodiment with the alternatives indicated, that are within the scope of the invention as defined in the attached claims.

The invention claimed is:

1. A method to be used when performing drilling in a well bore, comprising:

positioning a dual bore drill pipe in a well bore, thereby forming an outer annulus between a wall of the well bore and the dual bore drill pipe, the dual bore drill pipe having two inner bores therein and a tool at one end and being rotatable within the well bore during passage of fluid through the dual bore drill pipe;

dividing the outer annulus into a first section and a second section along the longitudinal axis of the dual bore drill pipe at a first location close to the tool, providing a first fluid in the first section of the outer annulus;

circulating a second fluid having a density less than a density of the first fluid into and out of the well bore through the dual bore drill pipe, wherein the densities of the first and second fluids are selected such that a combined weight of the second fluid and the dual bore drill pipe for a volume unit is less than a weight of the first fluid for the same volume unit, allowing the dual bore drill pipe to be at least partly floating in the first fluid in the outer annulus; and rotating the dual bore drill pipe during at least a portion of circulating the second fluid through the dual bore drill pipe.

2. The method according to claim 1, wherein the outer annulus is divided into the first and second sections by a divider element disposed in the outer annulus, and wherein there is substantially no pressure difference across the divider element.

3. The method according to claim 1, wherein in the circulating the second fluid, the second fluid flows into the well bore through an inner annular space formed by one of the bores in the dual bore drill pipe and out of the well bore through a central bore formed by the other bore of the dual bore drill pipe.

4. The method according to claim 1, further comprising dividing the first section of the outer annulus into a first subsection and a second subsection at a second location spaced apart from the first location, wherein the first fluid is provided in the first subsection, and further comprising providing a third fluid in the second subsection.

5. The method according to claim 4, wherein the first section is divided into the first subsection and the second subsection by a sealing element, and further comprising providing a pressurized movement fluid in the second subsection to drive the tool into the well bore.

6. The method according to claim 1, wherein dividing the outer annulus into the first and second sections comprises dividing the outer annulus in an unlined well bore.

7. A drilling device comprising:

a dual bore drill pipe arranged for rotation in a well bore, a tool attached at one end of the dual bore drill pipe, wherein the dual bore drill pipe and tool are configured such that a fluid is delivered down to the tool through a first bore in the drill pipe and returned to the surface through a second bore in the drill pipe, a divider element attached around the outside of the drill pipe at the connection of the tool to the drill pipe, the divider element being configured to divide an outer annular space formed between the dual bore drill pipe and a wall of the well bore into at least a first and a second annular section, and means for providing a first fluid with a first density in the first annular section and a second fluid with a second density in the second annular section and within the drill pipe, such that a combined weight of the second fluid and the dual bore drill pipe for a volume unit is less than a weight of the first fluid for the same volume unit, wherein the drill pipe is configured to at least partly float in the first fluid in the outer annular space.

8. The drilling system according to claim 7, wherein the divider element is arranged where there is substantially no pressure difference across the divider element.

9. The drilling device according to claim 7, wherein the dual bore drill pipe comprises an outer pipe and an inner pipe arranged to form an inner annular space between the outer pipe and the inner pipe.

10. The drilling device according to claim 7, further comprising a sealing element arranged around the drill pipe in a distance from the divider element, the sealing element being configured to divide the first annular section in further two sections, and means for providing a third pressurized movement fluid in a first annular space behind the sealing element, for performing pressure assisted drilling in the well.

11. The drilling device according to claim 7, wherein the divider element comprises at least one disk element.

12. The drilling device according to claim 7, wherein the dual bore drill pipe comprises an outer pipe and an inner pipe, wherein an annular space formed between the outer pipe and the inner pipe provides the first bore of the dual bore drill pipe, and wherein a central bore of the inner pipe provides the second bore of the dual bore drill pipe.

13. The drilling device according to claim 12, wherein the tool comprises a dual float valve and a drill bit, the dual float valve being configured to direct flow from the first bore of the dual bore drill pipe to a central bore of the drill bit and from the outer annular space to the second bore of the dual bore drill pipe.

* * * * *